US006739384B2

(12) United States Patent
Schoen et al.

(10) Patent No.: US 6,739,384 B2
(45) Date of Patent: May 25, 2004

(54) METHOD OF CONTINUOUSLY CASTING ELECTRICAL STEEL STRIP WITH CONTROLLED SPRAY COOLING

(75) Inventors: Jerry W. Schoen, Middletown, OH (US); Robert S. Williams, Fairfield, OH (US); Glenn S. Huppi, Monroe, OH (US)

(73) Assignee: AK Properties, Inc., Middletown, OH (US)

( * ) Notice: Subject to any disclaimer, the term of this patent is extended or adjusted under 35 U.S.C. 154(b) by 53 days.

(21) Appl. No.: 10/243,020

(22) Filed: Sep. 13, 2002

(65) Prior Publication Data

US 2003/0062147 A1 Apr. 3, 2003

Related U.S. Application Data

(60) Provisional application No. 60/318,971, filed on Sep. 13, 2001.

(51) Int. Cl.[7] ..... B22D 11/06

(52) U.S. Cl. ..... 164/480; 164/486; 164/455; 148/111; 148/112

(58) Field of Search ..... 164/480, 455, 164/486, 444, 428, 414; 148/111, 112

(56) References Cited

U.S. PATENT DOCUMENTS

| | | | | |
|---|---|---|---|---|
| 3,115,430 A | | 12/1963 | Jackson et al. | |
| 3,287,183 A | | 11/1966 | Taguchi et al. | |
| 3,727,669 A | * | 4/1973 | Arbitrio et al. | 164/486 |
| 3,764,406 A | | 10/1973 | Littmann | |
| 3,853,641 A | | 12/1974 | Sakakura et al. | |
| 4,115,161 A | | 9/1978 | Datta | |

(List continued on next page.)

FOREIGN PATENT DOCUMENTS

| | | |
|---|---|---|
| JP | 02 258149 A | 10/1990 |
| JP | 03 061326 A | 3/1991 |
| JP | 03 072027 A | 3/1991 |
| JP | 03 285018 A | 12/1991 |
| JP | 04 006222 A | 1/1992 |
| JP | 04 157119 A | 5/1992 |
| JP | 04 362135 A | 12/1992 |
| JP | 04 362136 A | 12/1992 |
| JP | 04 367353 A | 12/1992 |
| JP | 05 279741 A | 10/1993 |
| JP | 05 285593 A | 11/1993 |
| JP | 05 295440 A | 11/1993 |
| JP | 06 031394 A | 2/1994 |

OTHER PUBLICATIONS

Koizumi et al., "Characteristics of MnS Particles in the Unique Processing of Grain Oriented Silicon Steel from their Cast Slabs," Tetsu to Hagane 66(8):1123–1132 (1980).

Koizumi et al., "Study of the Method of Controlling the Precipitation Behaviour of MnS and AlN in Unique Manufacturing Process of Grain Oriented 3% Silicon Steel," Tetsu to Hagane 66(9):1351–1360 (1980).

Iwanaga et al., "Effect of Initial Texture on Secondary Recrystallization of Grain–Oriented Electrical Steel," J. Mtls. Engineering & Performance 3(2):223–227 (1994).

*Primary Examiner*—Tom Dunn
*Assistant Examiner*—I-H. Lin
(74) *Attorney, Agent, or Firm*—Frost Brown Todd LLC

(57) ABSTRACT

A method for continuously casting grain oriented electrical steel is disclosed. This method utilizes a controlled rapid cooling step, such as one using a water spray, to control the grain orientation in the finished product. The product formed not only has the appropriate grain orientation but also has good physical properties, for example, minimized cracking. In this process, after a continuously cast electrical steel strip is formed, the strip undergoes an initial secondary cooling to from about 1150 to about 1250° C., and finally undergoes a rapid secondary cooling (for example, by water spray) at a rate of from about 65° C./second to about 150° C./second to a temperature of no greater than about 950° C.

22 Claims, 1 Drawing Sheet

U.S. PATENT DOCUMENTS 4,596,614 A * 6/1986 Marder et al. ..... 148/111
4,718,951 A 1/1988 Schoen
5,049,204 A 9/1991 Iwanaga et al.
5,051,138 A 9/1991 Iwanaga et al.
5,066,343 A 11/1991 Nakashima et al.
5,286,316 A 2/1994 Wade
5,288,735 A 2/1994 Trager et al.
5,417,772 A 5/1995 Bavay et al.
5,477,911 A 12/1995 Ginzburg
5,482,107 A * 1/1996 Judd ..... 164/480
5,597,424 A * 1/1997 Yoshitomi et al. ..... 148/111
5,702,539 A 12/1997 Schoen et al.
5,720,335 A 2/1998 Osada et al.
5,810,070 A 9/1998 Osada et al.
5,816,311 A 10/1998 Osada et al.
5,871,039 A 2/1999 Osada et al.
5,924,476 A 7/1999 Spink
5,983,981 A 11/1999 Spink
6,032,722 A 3/2000 Russell et al.
6,079,480 A * 6/2000 Oka et al. ..... 164/452
6,129,136 A 10/2000 Tibbs et al.
6,152,210 A 11/2000 Baharis et al.
6,164,366 A 12/2000 Fish et al.
6,237,673 B1 5/2001 Kato et al.
6,257,315 B1 7/2001 Spink
6,273,178 B1 8/2001 Osada et al.
6,432,222 B2 * 8/2002 Ohata et al. ..... 148/111

* cited by examiner

*Cooling water spray on both sides of strip.

| ZONE | Flow Rate Per Side** |
|---|---|
| A | 407 lpm/m$^2$ |
| B | 285 lpm/m2 |
| C | 204 lpm/m2 |

**Liters per minute per square meter of surface area.

METHOD OF CONTINUOUSLY CASTING ELECTRICAL STEEL STRIP WITH CONTROLLED SPRAY COOLING

CROSS-REFERENCE TO RELATED APPLICATION

This present application is related to and claims priority from U.S. Provisional Application No. 60/318,971, Schoen et al., filed Sep. 13, 2001.

TECHNICAL FIELD

The present invention relates to a method for producing a grain oriented electrical steel strip with good magnetic properties from a continuously cast thin strip. The cast strip is cooled in a manner whereby a grain growth inhibitor needed to develop the grain orientation by the process of secondary grain growth is precipitated as a finely and uniformly dispersed phase. The cast strips produced by the present invention exhibit very good physical characteristics.

BACKGROUND OF THE INVENTION

Grain oriented electrical steels are characterized by the type of grain growth inhibitors used, the processing steps used and the level of magnetic properties developed. Typically, grain oriented electrical steels are separated into two classifications, conventional (or regular) grain oriented and high permeability grain oriented, based on the level of the magnetic permeability obtained in the finished steel sheet. The magnetic permeability of steel is typically measured at a magnetic field density of 796 A/m and provides a measurement of the quality of the (110)[001] grain orientation, as measured using Millers indices, in the finished grain oriented electrical steel.

Conventional grain oriented electrical steels typically have magnetic permeability measured at 796 A/m of greater than 1700 and below 1880. Regular grain oriented electrical steels typically contain manganese and sulfur (and/or selenium) which combine to form the principal grain growth inhibitor(s) and are processed using one or two cold reduction steps with an annealing step typically used between cold reduction steps. Aluminum is generally less than 0.005% and other elements, such as antimony, copper, boron and nitrogen, may be used to supplement the inhibitor system to provide grain growth inhibition. Conventional grain oriented electrical steels are well known in the art. U.S. Pat. Nos. 5,288,735 and 5,702,539 (both incorporated herein by reference) describe exemplary processes for the production of conventional grain oriented electrical steel whereby one or two steps of cold reduction, respectively, are used.

High permeability grain oriented electrical steels typically have magnetic permeability measured at 796 A/m of greater than 1880 and below 1980. High permeability grain oriented electrical steels typically contain aluminum and nitrogen which combine to form the principal grain growth inhibitor with one or two cold reduction steps with an annealing step typically used prior to the final cold reduction step. In many exemplary processes for the production of high permeability grain oriented electrical steels in the art, other additions are employed to supplement the grain growth inhibition of the aluminum nitride phase. Such exemplary additions include manganese, sulfur and/or selenium, tin, antimony, copper and boron. High permeability grain oriented electrical steels are well known in the art. U.S. Pat. Nos. 3,853,641 and 3,287,183 (both incorporated herein by reference) describe exemplary methods for the production of high permeability grain oriented electrical steel.

Grain oriented electrical steels are typically produced using ingots or continuously cast slabs as the starting material. Using present production methods, grain oriented electrical steels are processed wherein the starting cast slabs or ingots are heated to an elevated temperature, typically in the range of from about 1200° C. to about 1400° C., and hot rolled to a typical thickness of from about 1.5 mm to about 4.0 mm, which is suitable for further processing. The slab reheating in current methods for the production of grain oriented electrical steels serves to dissolve the grain growth inhibitors which are subsequently precipitated to form a fine dispersed grain growth inhibitor phase. The inhibitor precipitation can be accomplished during or after the step of hot rolling, annealing of the hot rolled strip, and/or annealing of the cold rolled strip. The additional step of breakdown rolling of the slab or ingot prior to heating of the slab or ingot in preparation for hot rolling may be employed to provide a hot rolled strip which has microstructural characteristics better suited to the development of a high quality grain oriented electrical steel after further processing is completed. U.S. Pat. Nos. 3,764,406 and 4,718,951 (both incorporated herein by reference) describe exemplary prior art methods for the breakdown rolling, slab reheating and hot strip rolling used for the production of grain oriented electrical steels.

Typical methods used to process grain oriented electrical steels may include hot band annealing, pickling of the hot rolled or hot rolled and annealed strip, one or more cold rolling steps, a normalizing annealing step between cold rolling steps and a decarburization annealing step between cold rolling steps or after cold rolling to final thickness. The decarburized strip is subsequently coated with an annealing separator coating and subjected to a high temperature final annealing step wherein the (110)[001] grain orientation is developed.

A strip casting process would be advantageous for the production of a grain oriented electrical steel since a number of the conventional processing steps used to produce a strip suitable for further processing can be eliminated. The processing steps which can be eliminated include, but are not limited to, slab or ingot casting, slab or ingot reheating, slab or ingot breakdown rolling, hot roughing and hot strip rolling. Strip casting is known in the art and is described, for example, in the following U.S. Pat. Nos. (all of which are incorporated herein by reference): 6,257,315; 6,237,673; 6,164,366; 6,152,210; 6,129,136; 6,032,722; 5,983,981; 5,924,476; 5,871,039; 5,816,311; 5,810,070; 5,720,335; 5,477,911; and 5,049,204. When employing a strip casting process, at least one casting roll and, preferably, a pair of counter rotating casting rolls is used to produce a strip that is less than about 10 mm in thickness, preferably less than about 5 mm in thickness and, more preferably, about 3 mm in thickness. The application of strip casting to the production of grain oriented electrical steels differs from processes established for the production of stainless steels and carbon steels due to the technically complex roles of the grain growth inhibitor system (such as MnS, MnSe, AlN and the like), grain structure and crystallographic texture which are essential to produce the desired (110)[001] texture by secondary grain growth.

SUMMARY OF THE INVENTION

The present invention relates to a process for producing grain oriented electrical steel from a cast strip wherein rapid secondary cooling of the cast strip is employed to control the precipitation of the grain growth inhibiting phases. The cooling process can be accomplished by the direct application of cooling sprays, directed cooling air/water mist, or impingement cooling of the cast strip onto solid media such as a metal belt or sheet. While the cast strip is typically produced using a twin roll strip caster, alternative methods using a single casting roll or a cooled casting belt may also be used to produce a cast strip having a thickness of about 10 mm or less.

Specifically, the present invention provides a method for producing grain oriented electrical steel strip comprising the steps of:

(a) forming a continuously cast electrical steel strip having a thickness of no greater than about 10 mm;

(b) cooling said strip to a temperature of from about 1150° C. to about 1250° C. such that it becomes solidified; and (c) subsequently performing a rapid secondary cooling on said steel strip wherein the strip is cooled at a rate of from about 65° C./second to about 150° C./second to a temperature of no greater than about 950° C.

In one embodiment, the steel strip produced by the foregoing process is coiled at a temperature below about 850° C., preferably below about 800° C.

In another embodiment, the present invention provides a method for producing a grain oriented electrical steel strip comprising the steps of:

(a) forming a continuously cast electrical steel strip having a thickness of no greater than about 10 mm;

(b) cooling said strip to a temperature below about 1400° C. such that it becomes at least partially solidified;

(c) performing an initial secondary cooling on said solidified strip to a temperature of from about 1150° C. to about 1250° C.; and (d) subsequently performing a rapid secondary cooling on said steel strip wherein the strip is cooled at a rate of from about 65° C./second to about 150° C./second to a temperature of no greater than about 950° C.

In one embodiment of this invention, the steel strip produced by the foregoing process is coiled at a temperature below about 850° C., preferably below about 800° C.

This process provides a grain oriented electrical steel having the appropriate grain orientation, and also provides steel with good physical properties, such as reduced cracking.

For purposes of clarity, the rate of cooling during solidification will be considered to be the rate at which the molten metal is cooled through the casting roll or rolls wherein the substantially solidified cast strip is cooled to a temperature at or above about 1350° C. The secondary cooling of the cast strip will be considered divided into two stages: (i) initial secondary cooling is conducted after solidification to a temperature range of about 1150 to 1250° C., and, (ii) rapid secondary cooling is employed after the strip is discharged from the initial cooling and serves to control the precipitation of the grain growth inhibiting phase(s) present in the steel.

Prior to initiation of rapid secondary cooling, it is an optional feature of the present invention to slow the rate of initial secondary cooling of the cast strip to allow the strip temperature to equalize before initiating rapid secondary cooling. For example, the cast and solidified strip may be discharged into and/or pass through an insulated chamber (see FIG. 1) to both slow the initial secondary cooling rate and/or to equalize the strip temperature after solidification. Although not critical to the practice of the present invention, a nonoxidizing atmosphere may be optionally used in the chamber to minimize the surface scaling, thereby helping to maintain a low surface emissivity which can further slow the rate of initial secondary cooling preceding the rapid secondary cooling of the present invention. These optional configurations are helpful as they permit rapid secondary cooling of the solidified strip to be conducted at a substantially greater distance from the strip casting machine, thereby, providing some isolation of the liquid steel handling and strip casting equipment from the rapid secondary cooling equipment. In this manner, any negative interaction between the media used for the rapid secondary cooling process of the present invention and the liquid steel handling and/or strip casting process and/or equipment can be minimized. For example, if a water spray or a water/air mist is used as the cooling media, the liquid steel and/or strip casting equipment must be protected from any steam formed as a result of rapid secondary cooling. Moreover, conducting both the initial and rapid secondary cooling in a nonoxidizing atmosphere will minimize metal yield losses due to oxidation of the strip during cooling.

During solidification, the liquid metal is cooled at a rate of at least about 100° C./second to provide a cast and solidified strip having a temperature in excess of about 1300° C. The cast strip is subsequently cooled to a temperature of about 1150° C. to about 1250° C. at a rate of at least about 10° C./second, whereupon the strip is subjected to rapid secondary cooling to reduce the strip temperature from about 1250° C. to about 850° C. In the broad practice of this invention, rapid secondary cooling is conducted at a rate of at least about 65° C./second while a preferred cooling rate is at least about 75° C./second, and a more preferred rate is at least about 100° C./second. The cast and cooled strip may be coiled at a temperature below about 800° C. for further processing.

In the practice of the invention, several methods for the rapid secondary cooling have been employed such as direct impingement cooling to provide a cooling rate at or in excess of about 150° C./second or water spray cooling to provide a cooling rate at or in excess of about 75° C./second. It has been further found in the development of the present invention that producing a cast and rapidly cooled electrical steel strip with good mechanical and physical characteristics may limit the rate of rapid secondary cooling. Rapid secondary cooling at rates in excess of about 100° C./second requires that the strip be cooled in a manner which prevents significant temperature differentials to develop during cooling since the strain created by differential cooling has been found to result in cracking of the cast strip, making the cast strip unusable for further processing.

The conditions for the rapid secondary cooling steel strip may be controlled using a system comprising a spray nozzle design wherein the rapid cooling is provided by establishing a desired spray water density. The spray density may be controlled by the water flow rate, the number of spray nozzles, the nozzle configuration and type, spray angle and length of cooling zone. It has been found that a water spray density of from about 125 liters per minute per square meter of surface area (l/[min-m$^2$]) to about 450 l/[min-m$^2$] provides the desired cooling rate. Since it is difficult to monitor the strip temperature during water spray cooling due to the variations in and turbulence of the water film applied onto the strip, water spray density measurements are typically used.

The term "strip" is used in this description to describe the electrical steel material. There are no limitations on the width of the cast material except as limited by the width of the casting surface of the roll(s). The cast and cooled strip is typically further processed using hot and/or cold rolling of the strip, annealing of the strip prior to cold rolling to final thickness in one or more stages, annealing between cold rolled stages if more than more than one cold reduction stage is used, decarburization annealing of the finally cold rolled strip to lower the carbon content to less than about 0.003%, applying an annealing separator coating such as magnesia, and a final annealing step wherein the (110)[001] grain orientation is developed by the process of secondary grain growth and the final magnetic properties are established.

DETAILED DESCRIPTION OF THE INVENTION

Figure 1:
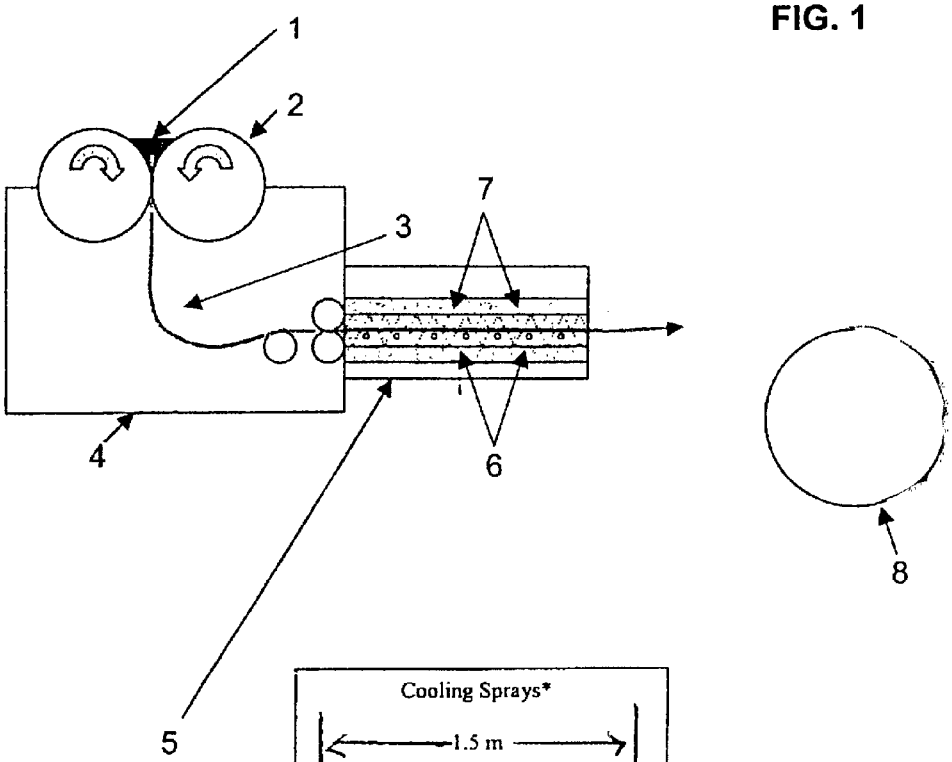
FIG. 1 is a simple layout for a twin drum caster to illustrate use of the process of the present invention.
Figure 1:
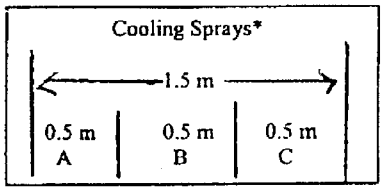

The development of the (110)[001] grain orientation is important in achieving the desired magnetic properties in a conventional or high permeability grain oriented electrical steel strip. To achieve such grain orientation, several conditions should be satisfied. These include: (i) the presence of nuclei grains having an orientation at or near (110)[001]; (ii) the presence of a primary recrystallized structure with a distribution of crystalline orientations which foster the growth of (110)[001] nuclei; and (iii) a means of retarding the primary grain growth of the non-(110)[001] oriented grains and allowing the (110)[001] oriented grains to preferentially grow and consume the non-(110)[001] oriented grains. The inclusion of a fine, uniform dispersion of inhibitor particles, such as MnS and/or AlN, is a common means of achieving such grain growth inhibition.

The cooling rates provided by present conventional methods of slab or ingot casting provide very slow cooling during and after solidification, resulting in the precipitation of the inhibitor phase(s) as a coarse particulate. In the application of strip casting to the production of grain oriented electrical steels, the formation of the coarse inhibitor particulate phase commonly found in ingots and continuous slab casting can be avoided by controlled cooling of the cast strip. Accordingly, the inhibitor phase(s) can be precipitated into fine and dispersed form in the cast and cooled strip, thereby eliminating the need for a high temperature slab reheating treatment to dissolve the grain growth inhibiting phase(s).

For the present invention, the liquid steel may be solidified into a strip form using either a single or two opposing counter rotating casting rolls or drums (or twin roll), cast onto a moving cooling belt or strip, or a combination thereof. In a typical method of the present invention, the cast steel strip is produced using a twin roll strip casting machine. In such a process, the liquid steel, typically at a temperature above 1500° C., is cooled at a rate of at least about 100° C./second to provide a cast and solidified strip, said cast strip exiting the twin roll casting machine at a temperature of about 1350° C. After exiting the casting roll(s), the strip is further cooled to a temperature of from about 1250° C. to about 1150° C., at which temperature the cast strip is subjected to rapid secondary cooling at a rate of greater than about 65° C./second; and preferably greater than about 70° C./second; more preferably greater than about 75° C./second; and, most preferably at a rate of greater than about 100° C./second, to lower the strip temperature to below about 950° C.; preferably below about 850° C.; preferably below about 800° C.; and, more preferably, below about 750° C.; and, most preferably, below about 700° C. The time required for rapid secondary cooling is a function of the production speed of strip caster, the rapid secondary cooling rate and the desired length of the rapid secondary cooling zone. In the practice of the present invention, it is preferred that rapid secondary cooling be applied with a high degree of uniformity both across the width of the strip and on the top and bottom surfaces of the strip, particularly at the end of the cooling zone (see FIG. 1). In this manner, a strip with good physical integrity and free of cracks can be produced.

The spray density of the cooling water is the preferred method for defining the cooling rate. The spray density is given by the following expression:

$$\text{Spray Density}=Q/(\pi/4)d^2$$

Where:

Q=water flow rate (using a single nozzle)

d=diameter of spray area

In the practice of the present invention, the water spray density typically used is between about 125 and about 450 l/[min-m$^2$; preferably between about 300 and about 400 l/[min-m$^2$]; and, more preferably between about 330 and about 375 l/[min-m$^2$]. The temperature of the water used for cooling is preferably between about 10° C. and about 75° C., preferably about 25° C. The spray on a given area of strip typically lasts between about 3 and about 12 seconds, preferably between about 4 and about 9 seconds (i.e., the length of time the strip is in the spray zone).

FIG. 1 is a simple layout for a twin drum caster which utilizes the process of the present invention. In the embodiment shown in this figure, molten steel (1) moves through the twin roll caster (2), forming steel strip (3). The strip (3) discharges from the caster at about 1300° C.–1400° C. The strip (3) moves through an insulated initial cooling chamber (4) wherein the temperature of the strip is reduced to about 1200° C. This chamber (4) slows the cooling rate of the strip to allow the water cooling system to be located at a greater distance from the caster. The strip then moves to a water spray cooling system (5) which includes rollers (6) for moving the strip through and water sprays (7) on both sides of the strip. It is here that the rapid secondary cooling takes place. The water sprays (7) cool the strip from about 1200° C. to about 800° C. In this particular embodiment, the spray is divided into three discrete zones, each of which has a different water spray density (as indicated in the figure). After cooling, the strip is coiled on a coiler (8), at a temperature below about 800° C. Typically, the coiling temperature is about 725° C.

EXAMPLE 1

A conventional grain oriented electrical steel having the composition shown in Table I is melted and cast into a sheet having a thickness of about 2.9 mm and a width of about 80 mm. The cast sheets are held at a temperature of about 1315° C. for a time of about 60 seconds in a nonoxidizing atmosphere and cooled at a rate of about 25° C./second in ambient air to a temperature of about 1200° C. The sheets are subsequently subjected to rapid secondary cooling by water spraying both surfaces for a time of about 7 seconds at which point the surface temperature of the sheet is at or below about 950° F.

TABLE I

Composition of Grain Oriented Electrical Steel

| C | Mn | S | Si | Cr | Ni | Cu | Al | N |
|---|---|---|---|---|---|---|---|---|
| 0.034 | 0.056 | 0.024 | 3.10 | 0.25 | 0.08 | 0.09 | <0.0030 | <0.0060 |

Table II summarizes the conditions used for and results from the applications of rapid secondary cooling:

TABLE II

Effect of Cooling Spray Water Density on Physical Quality of Strip Cast Grain Oriented Electrical Sheet Steel

| Test Run | Cooling Water Temperature, ° C. | Spray Duration, seconds | Cooling Water Pressure, kPascals | Maximum Water Spray Density, liters/(min-m$^2$) per side | Cracking |
|---|---|---|---|---|---|
| 1 | 25° C. | 7 seconds | 1241 | 1108 | yes |
| 2 | 25° C. | 7 seconds | 552 | 739 | yes |
| 3 | 25° C. | 7 seconds | 345 | 358 | no |
| 4 | 25° C. | 7 seconds | 345 | 358 | no |
| 5 | 25° C. | 7 seconds | 414 | 451 | no |
| 6 | 25° C. | 7 seconds | 483 | 572 | yes |
| 7 | 25° C. | 7 seconds | 483 | 571 | yes |

The effect of using cooling water spray densities exceeding about 570 l/[min-m$^2$] and up to 1100 l/[min-m$^2$] per side on each sheet surface resulted in cracking of the steel sheet during rapid secondary cooling.

EXAMPLE 2

Additional samples of the conventional grain oriented electrical steel of Example 1 were subjected to the rapid secondary cooling of the cast strip as shown in Table III below.

TABLE III

Effect of Cooling Spray Water Density on Physical Quality of Strip Cast Grain Oriented Electrical Steel Sheet

| Test Run | Water Temperature, ° C. | Water Pressure, kPascals | Maximum Water Spray Density, liters/(min-m$^2$) | Spray Duration, seconds | End-Cooling Temperature, ° C. | Cracking | Quality of MnS Precipitation |
|---|---|---|---|---|---|---|---|
| 1 | 25° C. | 1379 | 398 | >20 seconds | 100° C. | slight | |
| 2 | 25° C. | 1207 | 359 | 3.4 seconds | 100° C. | no | Fair - Little precipitation |
| 3 | 25° C. | 862 | 332 | 4.0 seconds | — | no | Fair - Little precipitation |
| 4 | 25° C. | 862 | 332 | 8.5 seconds | | no | Good - Fine and uniformly dispersed MnS precipitation |
| 5 | 25° C. | 689 | 329 | 4.4 seconds | — | no | Good - Fine and uniformly dispersed MnS precipitation |
| 6 | 25° C. | 517 | 305 | 8.3 seconds | 600° C. | no | Fair - slight coarsening of MnS precipitates, preferential precipitation on grain boundaries |
| 7 | 25° C. | 345 | 266 | 12.8 seconds | 600° C. | no | Fair - slight coarsening of MnS precipitates, preferential precipitation on grain boundaries |
| 8 | 25° C. | 345 | 199 | 17.0 seconds | 600° C. | no | Fair - slight coarsening of MnS precipitates, preferential precipitation on grain boundaries |

The spray density is varied from about 200 l/[min-m$^2$] to about 400 l/[min-m$^2$] per side while the ending temperature of the rapid secondary cooling method of the present invention is varied from about 100° C. and about 600° C. After cooling to room temperature, the sheets are inspected for physical characteristics and sectioned to examine the morphology of the grain growth inhibitor. As shown in Table III, rapid secondary cooling at a cooling water density in excess of about 300 l/[min-m$^2$] per side is sufficient to provide control of inhibitor precipitation while cooling water densities below about 300 l/[min-m$^2$] per side result in slight coarsening precipitation of the inhibitor phase.

EXAMPLE 3

Conventional grain oriented electrical steels having the compositions shown in Table IV are melted and cast into sheets of a thickness of about 2.5 mm using a twin roll strip caster. The cast and solidified sheet is discharged into air at a temperature of about 1415° C. and cooled in an insulated enclosure at a rate of about 15° C./second to a surface temperature of about 1230° C. at which point the cast strip is subjected to rapid secondary cooling using the water spray method of the present invention. Rapid secondary cooling is accomplished by applying spray water to both surfaces of the sheet.

TABLE IV

Composition of Grain Oriented Electrical Steel

| Example | C | Mn | S | Si | Cr | Ni | Cu | Al | N |
|---|---|---|---|---|---|---|---|---|---|
| A | 0.029 | 0.064 | 0.023 | 3.28 | 0.25 | 0.080 | 0.080 | 0.0060 | 0.0058 |
| B | 0.033 | 0.051 | 0.026 | 2.94 | 0.25 | 0.080 | 0.082 | 0.0005 | 0.0065 |

Steel A of Table IV is provided with rapid secondary cooling whereby a water spray density 1000 l/[min-m$^2$] on each surface of the sheet is applied for a time of about 5 seconds to lower the strip surface temperature from about 1205° C. to about 680° C. Steel B is provided with rapid secondary cooling using a water spray density of about 175 l/[min-m$^2$] for about 0.9 second followed by a 400 l/[min-m$^2$] application for about 4.5 seconds on each surface of the steel sheet to lower the strip surface temperature from about 1230° C. to about 840° C. The cast and cooled strip is air cooled to 650° C., coiled and cooled thereafter to room temperature.

Extensive cracking occurred with Steel A, resulting in a material which could not be further processed, while Steel B has excellent physical characteristics and is readily processable. Examination of the MnS precipitates showed that the cooling conditions used for Steels A and B both provide a fine and uniformly dispersed inhibitor, as was desired.

EXAMPLE 4

Sheet samples from Steel B of the prior example are processed using the following conditions. First, the cast strip is heated to about 150° C. and cold rolled to a range of a thickness of about 1.25 mm, about 1.65 mm and about 2.05 mm after which the sheets are annealed in a mildly oxidizing atmosphere for about 10–25 seconds at or above a temperature of about 1030° C. and a maximum temperature of about 1050° C. The samples are further cold rolled to a thickness of about 0.56 mm after which the sheets are annealed in a nonoxidizing atmosphere for about 10–25 seconds at or above a temperature of about 950° C. and a maximum temperature of about 980° C. The samples are cold rolled to a final thickness of about 0.26 mm after which the sheets are decarburization annealed to less than about 0.0025% carbon in a humidified hydrogen-nitrogen atmosphere using an annealing time of about 45–60 seconds at or above a temperature of about 850° C. and a maximum temperature of 870° C. The samples are then coated with an annealing separator coating comprised basically of magnesium oxide and further subjected to a high temperature anneal to effect secondary grain growth and to purify the steel of sulfur, selenium, nitrogen and like elements. The high temperature anneal is conducted such that the samples are heated in an atmosphere comprised of hydrogen using an annealing time of 15 hours to a temperature at or above 1150° C. After the high temperature anneal step is completed, the samples are scrubbed to remove any remaining magnesium oxide, sheared into dimensions appropriate for testing and stress relief annealed in an nonoxidizing atmosphere comprised of 95% nitrogen and 5% hydrogen, using an annealing time of two hours at or above 830° C., after which their magnetic properties are determined.

TABLE V

Magnetic Properties of Grain Oriented Steel

| Specimen ID | Thickness After First Cold Rolling (mm) | Sample Final Thickness | Magnetic Permeability at 796 A/m | Core Loss at 1.5 T and 60 Hz (w/kg) | Core Loss at 1.7 T and 60 Hz (w/kg) |
|---|---|---|---|---|---|
| B-1 | 2.03 | 0.262 | 1849 | 1.10 | 1.59 |
| | | 0.261 | 1847 | 1.05 | 1.57 |
| | | 0.261 | 1858 | 1.04 | 1.48 |
| | | 0.262 | 1841 | 1.12 | 1.65 |
| B-2 | 1.65 | 0.267 | 1849 | 1.10 | 1.60 |
| | | 0.266 | 1859 | 1.01 | 1.47 |
| | | 0.262 | 1872 | 1.04 | 1.47 |
| | | 0.263 | 1867 | 1.02 | 1.46 |
| B-3 | 1.27 | 0.264 | 1864 | 1.04 | 1.48 |
| | | 0.265 | 1862 | 1.11 | 1.60 |
| | | 0.263 | 1864 | 1.08 | 1.55 |
| | | 0.264 | 1848 | 1.13 | 1.66 |

The magnetic permeability measured at 796 A/m and core losses measured at 1.5T 60 Hz and 1.7T 60 Hz in Table show that Steel B (present invention) provides magnetic properties comparable to a conventional grain oriented electrical steel made using present conventional production methods.

What is claimed is:

1. A method for producing grain oriented electrical steel strip comprising the steps of:

(a) forming a continuously cast electrical steel strip having a thickness of no greater than about 10 mm;

(b) cooling said cast strip to a temperature of from about 1150° C. to about 1250° C. such that it becomes solidified; and (c) subsequently performing a rapid secondary cooling on said cast strip to a temperature less than about 950° C. at a rate of from about 65° C./second to about 150° C./second.

2. The method according to claim 1 wherein, following step (c), the cast strip produced is coiled at a temperature below about 800° C.

3. The method according to claim 2 wherein, for at least a portion of step (b), said strip is passed through an insulated cooling chamber.

4. The method according to claim 3 wherein the insulated cooling chamber contains a nonoxidizing atmosphere.

5. The method according to claim 2 wherein the rapid secondary cooling of the cast strip is conducted to a temperature no greater than about 700° C.

6. The method according to claim 2 wherein the rapid secondary cooling takes place at a rate of at least about 100° C./second.

7. The method according to claim 2 wherein the rapid secondary cooling takes place so as to maintain a relative temperature uniformity across the width of the cast strip.

8. The method according to claim 7 wherein the rapid secondary cooling takes place by a process selected from direct impingement cooling, air/water mist cooling, water spray cooling, and combinations thereof.

9. The method according to claim 8 wherein the rapid secondary cooling takes place by water spray cooling.

10. The method according to claim 9 wherein the water spray has a spray water density of from about 125 to about 450 l/[min-m$^2$].

11. The method according to claim 10 wherein the spray water has a temperature of from about 10 to about 75° C.

12. The method according to claim 11 wherein the duration of the spray on a given area of the strip is from about 3 to about 12 seconds.

13. The method according to claim 12 wherein the rapid secondary cooling takes place at a rate of at least about 75° C./second.

14. The method according to claim 13 wherein the rapid secondary cooling takes place at a rate of at least about 100° C./second.

15. The method according to claim 13 wherein the rapid secondary cooling takes place to a temperature of no greater than about 800° C.

16. The method according to claim 15 wherein the rapid secondary cooling takes place to a temperature of no greater than about 700° C.

17. The method according to claim 10 wherein the spray water density is from about 300 to about 400 l/[min-m$^2$].

18. A method for producing grain oriented electrical steel strip comprising the steps of:

(a) forming a continuously cast electrical steel strip having a thickness of no greater than about 10 mm;

(b) cooling said cast strip to a temperature below about 1400° C. such that it becomes at least partially solidified;

(c) performing an initial secondary cooling on said at least partially solidified cast strip to a temperature of from about 1150° C. to about 1250° C.; and (d) subsequently performing a rapid secondary cooling on said cast strip at a rate of from about 65° C./second to about 150° C./second, to a temperature of no greater than about 950° C.

19. The method according to claim 18 wherein, following step (d), the cast strip produced is coiled at a temperature of below about 800° C.

20. The method according to claim 19 wherein the rapid secondary cooling is done at a rate of at least about 100° C./second.

21. The method according to claim 20 wherein the initial secondary cooling is carried out at a rate of at least about 10° C./second.

22. The method according to claim 19 wherein the rapid secondary cooling is done by water spray cooling wherein the water spray has a water spray density of from about 125 to about 450 l/[min-m$^2$].

* * * * *